US005159581A

United States Patent [19]

Agans

[11] Patent Number: 5,159,581

[45] Date of Patent: Oct. 27, 1992

[54] MEDICINE REMINDER AND DISPENSER

[76] Inventor: Rita M. Agans, 313 Maple St., Oneida, N.Y. 13421

[21] Appl. No.: 865,180

[22] Filed: Apr. 8, 1992

[51] Int. Cl.[5] ..... G04B 47/00; B65D 83/04; G07F 11/00

[52] U.S. Cl. ..... 368/10; 206/538; 221/2; 221/9

[58] Field of Search ..... 368/10, 107-109; 221/2, 3, 9, 10, 12, 15; 206/534, 538

[56] References Cited

U.S. PATENT DOCUMENTS

| | | | |
|---|---|---|---|
| 3,911,856 | 10/1975 | Ewing | 116/121 |
| 4,473,156 | 9/1984 | Martin | 206/534 |
| 4,490,711 | 12/1984 | Johnston | 340/309.4 |
| 4,626,105 | 12/1986 | Miller | 368/10 |
| 4,660,991 | 4/1987 | Simon | 368/10 |
| 4,725,997 | 2/1988 | Urouhart et al. | 368/10 |
| 4,725,999 | 2/1988 | Tate | 368/10 |
| 4,731,765 | 3/1988 | Cole et al. | 368/10 |
| 4,768,177 | 8/1988 | Kehr et al. | 368/10 |
| 4,872,559 | 10/1989 | Schoon | 206/538 |
| 4,970,669 | 11/1990 | McIntosh et al. | 364/569 |

*Primary Examiner*—Vit W. Miska
*Attorney, Agent, or Firm*—Richard C. Litman

[57] ABSTRACT

A medicine reminder and dispensing apparatus having a plurality of containers arranged in rows and columns in a cabinet, each container including a slidable base plate and a fixed wall, drive apparatus for driving said slidable base plate in each of two directions, a microprocessor to control the dispensing apparatus in operation, an alarm connected to said microprocessor to alert a user that it is time to take or dole out a predetermined dose of medication, push button inputs to identify selected times for dispensing medication, and reset apparatus for resetting the base plates while the containers are resupplied. A top cover of the cabinet can be locked to prevent premature access to medication stored in the cabinet.

7 Claims, 6 Drawing Sheets

MEDICINE REMINDER AND DISPENSER

BACKGROUND OF THE INVENTION

1. Field Of The Invention

This invention relates to an apparatus to remind individuals to take medication at predetermined times extending over a seven day period, in combination with an apparatus to dispense the medication at the predetermined times, while preventing access to the remaining medication. The combined apparatus is controlled by a microprocessor to both provide an audible and/or visual alarm and to activate the dispensing apparatus.

Studies in the past have shown that a substantial number of patients, particularly the handicapped and the elderly, do not follow instructions in taking medication. This can result in the patient failing to take the medication, taking the wrong medication, taking an incorrect amount of the medication, or taking the medication at the wrong time, leading to either a drug overdose, or an ineffective application of the medication to the patients. Caretakers such as nurses also need to be reminded on occasion that a patient needs to take a particular medication at a predetermined time and what the dosage should be.

The medicine reminder of this invention solves this particular problem by providing an audible and/or visual alarm up to four times a day alerting the patient and/or the caretaker that medication is to be taken, and a means for automatically dispensing the proper medication under microprocessor control so as to be easily retrievable by the patient and/or caretaker, for periods of up to a week.

2. DESCRIPTION OF THE RELATED PRIOR ART

There have been a number of medication dispensing devices disclosed in the prior art. U.S. Pat. No. 3,911,856 issued Oct. 14, 1975 to Charles C. Ewing discloses a medication dispenser and schedule reminder which includes a date selector, a six hour spring-wound or battery operated timer having an alarm, and a manually rotatable top to select one of a plurality of compartments containing medication therein.

U.S. Pat. No. 4,473,156 issued Sep. 25, 1984 to David C. Martin discloses a method and apparatus for accurately selecting, storing and dispensing pills comprising a tray having four color coded containers for each day of the week coupled with manually removable slidable panels covering the containers, and a pivoted cover for the tray. There is no timer structure disclosed, or any means to lock the cover in position.

U.S. Pat. No. 4,660,991 issued Apr. 28, 1987 to Udo Simon discloses a device for storing and signalling the time for taking drugs comprising a dispenser which includes a timer having audio and visual means for indicating the time for taking the stored medications and sensors to indicate when a pill has been dispensed from a blister pack. There is no disclosure of an automatic pill dispenser under the control of a microprocessor by Simon.

U.S. Pat. No. 4,731,765 issued Mar. 15, 1988 to George W. Cole et al. discloses a medication reminder which includes a timer and a release latch mechanism which releases a latch on the cover over a compartment. Cole et al. disclose only a single compartment with the latch mechanism controlled by the timer.

U.S. Pat. No. 4,768,177 issued Aug. 30, 1988 to Bruce A. Kehr et al. discloses a method and apparatus for alerting a patient to take medication comprising a tray having plural compartments, and an electrical signalling system which emits audible and visible signals from time to time, each of which indicates that medication should be taken, from which compartments the medication should be taken, the quantity of medication to be taken from the designated compartment, and instructions for taking the medication. There is no disclosure by Kehr et al. of automatic dispensing of the medication under the control of a microprocessor.

U.S. Pat. No. 4,872,559 issued Oct. 10, 1989 to Heinrich Schoon discloses a dispenser for medical preparations comprising a plurality of compartments arranged in columns and rows, and manually slidable covers covering each column of compartments. There is no disclosure of a timer coupled to an alarm in Schoon.

U.S. Pat. No. 4,970,669 issued Nov. 13, 1990 to Kenneth B. McIntosh discloses a programmed clock for signalling a person times that dosages of medication are to be taken in compliance with a medication schedule. In addition to the programmed clock the apparatus comprises a microprocessor, alarm means, a pinter, and a plurality of compartments for holding the medication. There is no disclosure by McIntosh et al., however, of any automatic dispensing of medication from the plurality of compartments.

SUMMARY AND OBJECTS OF THE INVENTION

The invention disclosed herein comprises a medication dispensing arrangement comprising a clock, a pill holder having 28 compartments arranged in rows and columns, the columns each having at least four slidable support plates supporting medication designed to be transferred to an accessible pill tray up to four times a day for seven days, a microprocessor connected to said clock, a memory connected to said microprocessor, means to store in said memory selected times of actuating the dispensing of said medication, an alarm means to alert a patient or caregiver that it is time to take medication, said alarm means being connected to said microprocessor, and means to shift each of said support plates in serial fashion at the proper time under the control of said microprocessor to dispense a prescribed dose of medication. The apparatus is designed to be refilled with medication weekly, with means to shift the support plates in serial fashion in the opposite direction. A cover is provided which may be locked to prevent access to the medication before the prescribed time, thus minimizing the problem of providing an overdose.

Accordingly, it is an object of this invention to provide a medication dispenser which can be programmed to a) alert a patient or caregiver that it is time to take medication, and b) to dispense a proper dose.

It is a further object of this invention to provide a medication dispenser and an alarm means which may be preprogrammed for a period of seven days.

It is another object of this invention to provide a medication dispenser and an alarm means controlled by a microprocessor.

It is still another object of this invention to provide a medication dispenser and an alarm means which automatically dispenses medication at preselected times.

It is an additional object of this invention to provide a medication dispenser and an alarm means which can be controlled to prevent overdoses of medication.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 1:
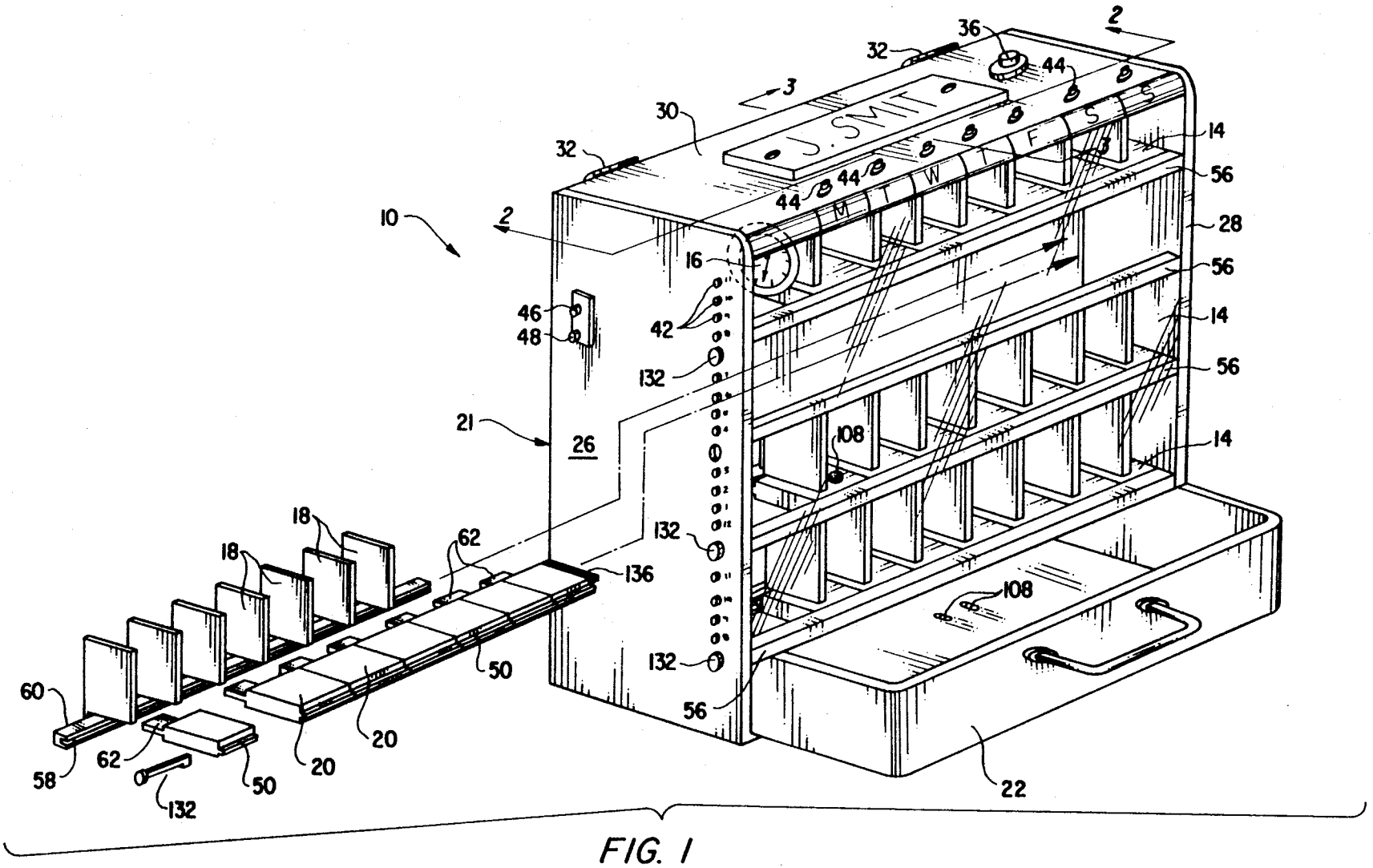
FIG. 1 is a partially exploded front perspective view of the medicine reminder and dispenser.

Turning now to FIG. 1, there is shown an automatic medication dispensing apparatus 10 in the form of a seven day pill box controlled by a microprocessor 76 (see FIG. 4), as further described below. Dispensing apparatus 10 comprises four rows of containers 14 disposed one on top of the other, thereby to provide eight vertical columns. The right-most seven columns are reversed for holding and dispensing the medication. The left-most vertical column is left empty except for the top row which provides a space for mounting a clock 16 and the aforesaid microprocessor 76 not shown in FIG. 1.

Figure 2:
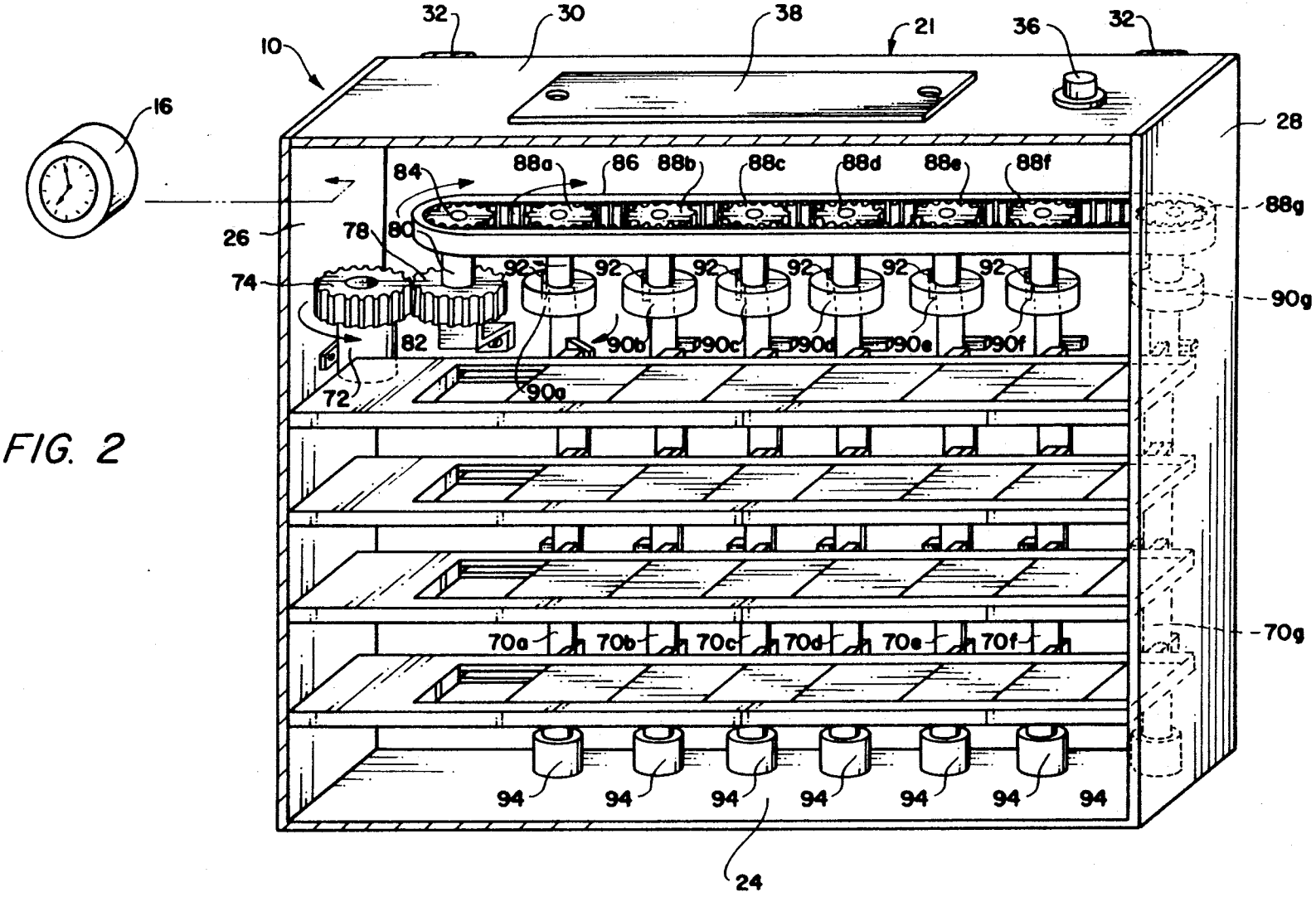
FIG. 2 is a partially exploded front perspective sectional view of the medicine reminder and dispenser taken along section line 2—2 in FIG. 1.

Each of the aforesaid containers 14 comprises fixed side walls 18 and a slidable base plate 20 which also provides a ceiling for the container 14 immediately below each row, including a bottom drawer 22 located at the base of the dispensing apparatus 10. Initially, the left-most column has no base plates 20 disposed thereunder, thereby providing room for the shifting of each base plate 20 at least one column to the left (FIG. 2).

Figure 3:
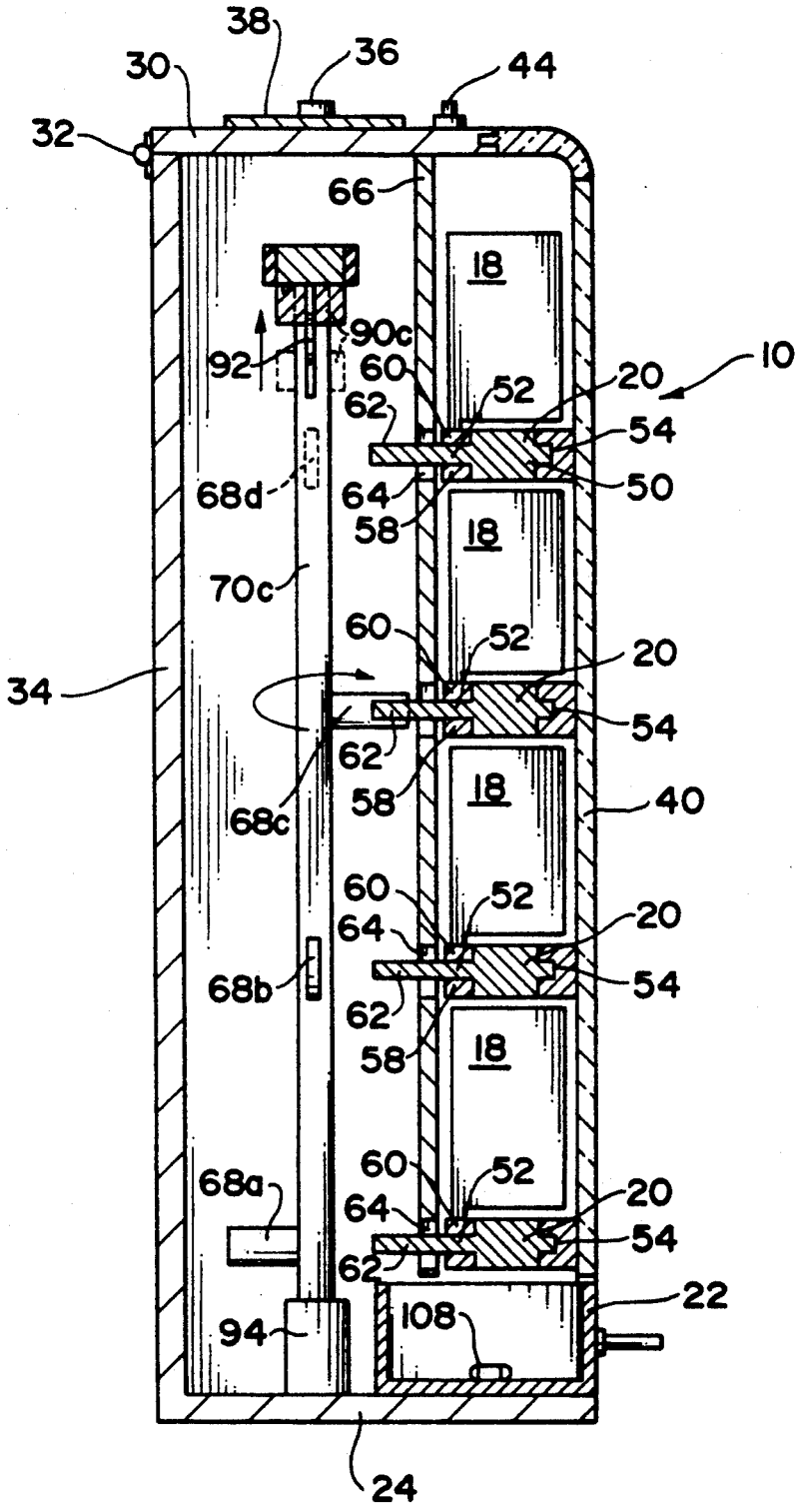
FIG. 3 is a side sectional view of the medicine reminder and dispenser taken along section line 3—3 in FIG. 1.

The dispensing apparatus 10 as shown in FIG. 1 further comprises a cabinet 21 which includes a horizontal base shelf 24 slidably supporting bottom drawer 22, a vertical left side wall 26 and a vertical right side wall 28 integral with said horizontal base shelf 24, a horizontal top cover 30 which is pivoted at hinges 32 mounted on a vertical back wall 34 integral with base shelf 24 (FIG. 3). Top cover 30 includes a conventional lock 36 to preclude improper access to the medication within containers 14, and an identification plate 38 bearing the name of the patient who is to receive the stored medication at predetermined selected times.

Access to the containers 14 from the front of dispensing apparatus 10 is prevented by a vertical transparent sheet 40 (see FIG. 3) which may be either glass or transparent plastic. Left side wall 26 supports a plurality of push button switches 42 each identifying a particular hour of the day starting with, for example, 8:00 A.M. and ending at 11:00 P.M., corresponding to the normal hours a patient might be awake. As shown, each row of containers 14 has four allotted hours, starting at the lowest switch 42 and going to the top switch 42. Along the front edge of the top cover 30, seven additional pushbutton switches 44, one for each day of the week, are shown. Also supported by left side wall 26 are two reset buttons 46 and 48. The operation of push buttons 42 and 44 and/or reset buttons 46 and 48 is described below in connection with FIGS. 4, 6, 8 and 9.

As shown for the third row from the bottom in FIG. 1 each bottom plate 20 is provided with a first tongue 50 at the front of base plate 20 and a second tongue 52 at the rear of base plate 20. First tongue 50 is supported by and slides in a continuous groove 54 (FIG. 3) in a front beam 56, and second tongue 52 is supported by and slides in a continuous groove 58 in a rear beam 60. Beams 56 and 60 are supported by left side wall 26 and right side wall 28. Side walls 18 are fixed to rear beam 60, and may also be fixed to front beam 56 if found to be desirable in any conventional manner.

Extending from second tongue 52 on each base plate 20 is a projection 62 which extends through a corresponding elongated slot 64 in a vertical panel 66 which separates containers 14 from the operating mechanism at the rear of the pill box or dispensing apparatus 10. The projection 62 will engage a corresponding paddle 68*a*–68*d* mounted on a corresponding vertical shaft 70*a*–70*g*.

Figure 4:
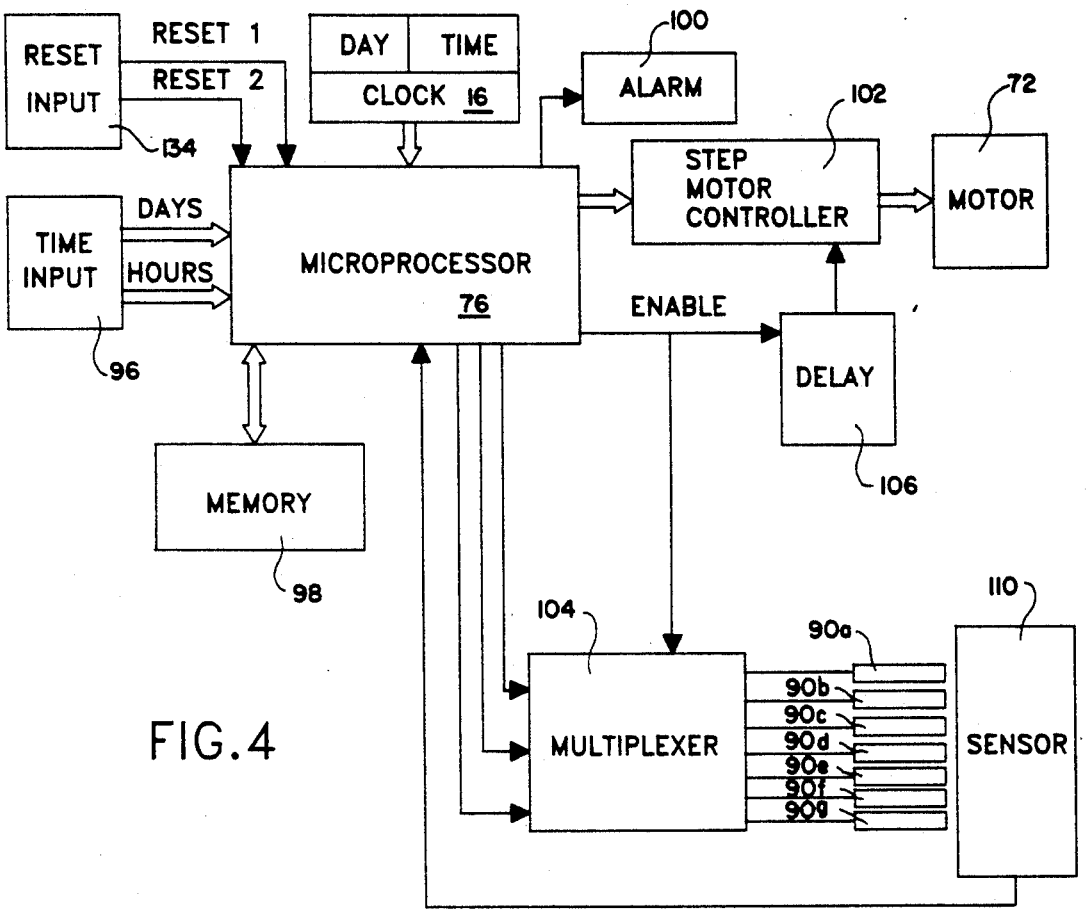
FIG. 4 is a schematic diagram showing the microprocessor control arrangement for the medicine reminder and dispenser.

The operating mechanism is best seen in FIGS. 2 and 3, with the electronic control therefor being shown in FIG. 4. Step motor 72 is suitably mounted on the inner surface of left side wall 26 and is controlled to rotate drive gear 74 in either the forward or reverse direction by microprocessor 76. Drive gear 74 in turn rotates driven gear 78 connected to a shaft 80 mounted for rotation on bracket 82 attached to back wall 34. Also connected to shaft 80 is a second gear 84 which drives timing belt 86. Mounted on shafts 70*a*–70*g* are freely rotatable gears 88*a*–88*g* which are simultaneously driven by timing belt 86 when actuated by step motor 72. Also mounted on shafts 70*a*–70*g* are vertically slidable electromagnetic clutches 90*a*–90*g* which may be selectively and individually activated under control of microprocessor 76 to selectively and individually engage a corresponding gear 88*a*–88*g*. As shown in FIG. 3 each electromagnetic clutch 90*a*–90*g* is connected to its corresponding shaft 70*a*–70*g* by a key and keyway arrangement 92 whereby engagement of the corresponding electromagnetic clutch 90*a*–90*g* with its corresponding gear 88*a*–88*g* will cause the corresponding shaft 70*a*–70*g* to rotate.

Each shaft 70a–70g has four paddles 68a–68d integral therewith mounted at vertical distances corresponding to the vertical distances of projections 62 extending from tongues 52 on base plates 20. Paddles 68a–68d are circumferentially located at 90 degree intervals on each shaft 70a–70g as shown in FIG. 3. Shafts 70a–70g are vertically supported for rotation by any conventional means such as bearings 94 mounted on base shelf 24. Additional support means connected, for example, to back wall 34, may be provided.

The control mechanism for the above-described operating mechanism is schematically shown in FIG. 4. The desired hours for dispensing medicine on each day is entered into the time input 96 by depressing push button switches 42 and 44. The corresponding signals are entered by time input 96 into microprocessor 76 and stored in memory 98. Subsequently, the time and day indicated by clock 16 is compared with the desired time and day stored in memory 98, and when there is a match microprocessor 76 activates alarm 100, step motor controller 102, and multiplexer 104, and sends an enable signal to a delay 106 and to said multiplexer 104. Alarm 100, which may be an audible and/or a visible signal, serves to alert the patient and/or a caretaker that it is time to take some medication. Multiplexer 104 serves to activate one or more of the electromagnetic clutches 90a–90g prior to activating step motor 72, under control of the ENABLE signal and delay 106. Step motor 72 is then actuated to drive the selected shaft 70a–70g 90 degrees in the forward direction enabling one of the paddles 68a–68d to engage and drive a corresponding projection 62 and connected base plate 20 one column to the left, the step motor 72 then being turned off. As disclosed, such operation starts at the left most base plate 20 at the bottom of the Monday column and sequentially moves each base plate 20 in the Monday column to the left at the selected hour. This allows the medication on each base plate 20 to be swept off the base plates 20 by side walls 18 as each base plate 20 from the bottom to the top of the Monday column is sequentially shifted to the left, thereby enabling the medication on each base plate 20 to fall to bottom drawer 22, as represented by pills 108, the medication then being retrievable by the patient or caretaker.

Thus, for Monday, shaft 70a is rotated clockwise 90 degrees four times to sequentially shift four base plates 20 to the left by the respective engagement of four vertically disposed paddles 68a–68d with their corresponding projections 62 at preselected hours. The same sequence is followed on Tuesday, Wednesday, Thursday, Friday, Saturday and Sunday, by sequentially activating electromagnetic clutches 90b–90g to sequentially drivingly connect shafts 70b–70g to step motor 72 through gears 88b–88g, timing belt 86, gear 84, shaft 80, gear 78 and gear 74. Sensors 110 monitor the engagement of electromagnetic clutches 90a–90g and the rotation of shafts 70a–70g to ensure accuracy.

Figure 5:
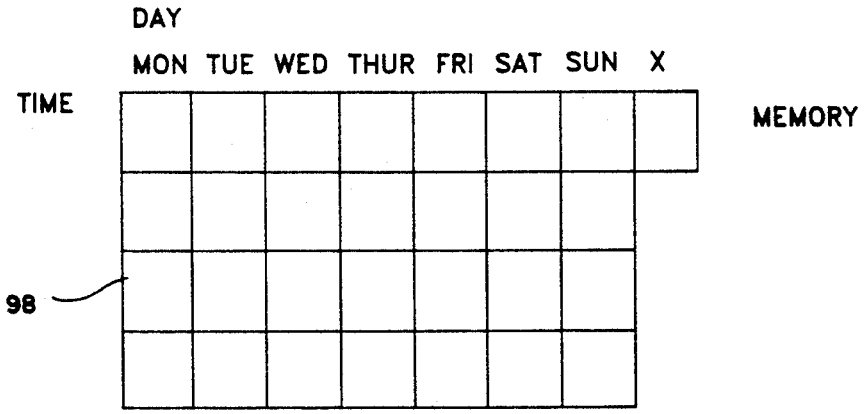
FIG. 5 is a schematic diagram of the memory portion of the microprocessor control arrangement.

Memory 98 is schematically shown in FIG. 5, with locations for storing the desired hours for each vertical column representing a day of the week, the location for storing a count signal being represented by the box labeled X.

Figure 6:
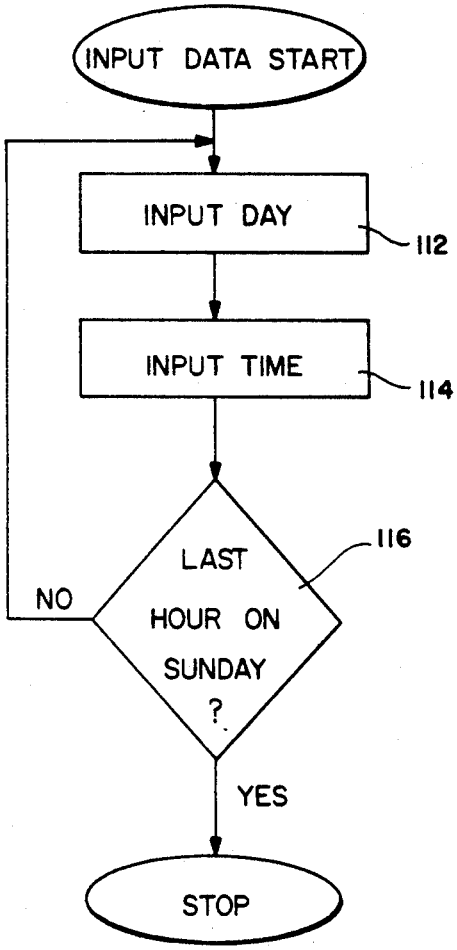
FIG. 6 is a flow chart showing the manner of inputting the desired times for activating an alarm and dispensing a predetermined amount of medication.

FIG. 6 shows the steps for loading the desired day and time for activating alarm 100 and dispensing predetermined medication. The day and time are input by manually actuating push buttons 44 and 42 as shown in steps 112 and 114. This operation is repeated until it is determined that one of the four buttons 42 representing 8 P.M., 9 P.M., 10 P.M. and 11 P.M. have been pushed for Sunday night, step 116, and then the inputting operation stops.

Figure 7:
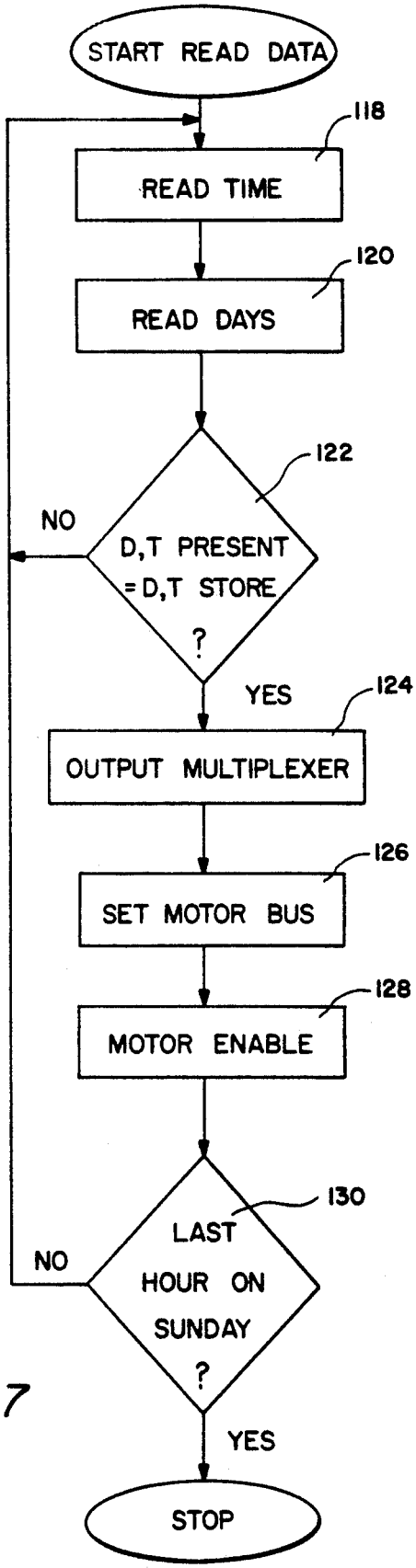
FIG. 7 is a flow chart indicating the manner of controlling the dispensing of a predetermined amount of medication at the desired time.

FIG. 7 is a flow chart showing the steps for dispensing medication at a selected time during a 7 day period, subsequently to loading the dispensing apparatus 10 with medication to be distributed. The microprocessor 76 reads the time and the days from clock 16, steps 118 and 120, and makes a comparison with the days and time stored in memory 98. Microprocessor 76 continues to read the time and days until there is a match, step 122. Once there is a match, the multiplexer 104 is set, step 124, the motor bus is set, step 126, and motor 72 is enabled, step 128. This operation is continued until there is an indication that a push button 42 has been depressed indicating a last hour on Sunday, step 130, after which the dispensing operation is stopped.

After a week's supply of medication has been dispensed, the dispensing apparatus 10 must be resupplied. This in turn requires the sequential shifting of the base plates 20 from the left to the right. This process requires rotating shafts 70a–70g 90 degrees in the forward or clockwise direction to locate paddles 68a on each shaft 70a–70g to the left of projections 62 extending from base plates 20 in the bottom row, and thereafter manually pushing the base plates 20 sufficiently to the right by push bars 132 to enable paddles 68a–68d to engage projections 62 when shafts 70a –70g are rotated in the reverse or counterclockwise direction. Referring again to FIG. 1, left side wall 26 additionally supports four push bars 132, one for each row of slidable base plates 20. When the base plates 20 are shifted to the left during the dispensing operation, pushbars 132 are also pushed to the left. During the resetting operation push bars 132 are pushed to the right after each of the shafts 70a–70g are simultaneously rotated an additional 90 degrees in the forward or clockwise direction to properly position paddles 68a–68d for the resetting operation. This latter result is achieved by depressing reset button 46 which sends a signal through reset input 134 to the microprocessor 76 to engage electromagnetic clutches 90a–90g and to operate step motor 72 for 90 degrees rotation of each shaft 70a–70g in the forward or clockwise direction. Dispensing apparatus 10 is now conditioned for resupply of medication.

Unlocking and raising cover 30 provides access to containers 14. Such resupply must be done in sequence starting with the bottom container 14 in the Sunday column and moving to the top container 14 in the same column, shifting each corresponding base plate 20 to the right, thereby providing a support for the medication deposited in each container 14. This result is achieved by depressing the second reset button 48 which sends a signal through Reset Input 134 to microprocessor 76 to engage electromagnetic clutch 90g with gear 88g and to thereafter rotate shaft 70g, through reversible step motor 72, 90 degrees in the reverse direction. Such operation shifts the lowest base plate 20 positioned in the Saturday column to the right into the Sunday column. Thereafter, the patient or the caretaker can insert whatever medication is prescribed for Sunday morning. This process is repeated until the last container 14 representing Monday evening is resupplied. As shown in FIG. 1 for the third row of base plates 20, the right-most base plate 20 in each row has a resilient bar 136 secured to the right side thereof for the purpose of shifting the reset base plates 20 sufficiently to the left to position the respective projections 62 to be engageable with the corresponding paddles 68a–68d when shafts 70a–70g are again rotated in the clockwise or forward direction during the dispensing operation.

Figure 8:
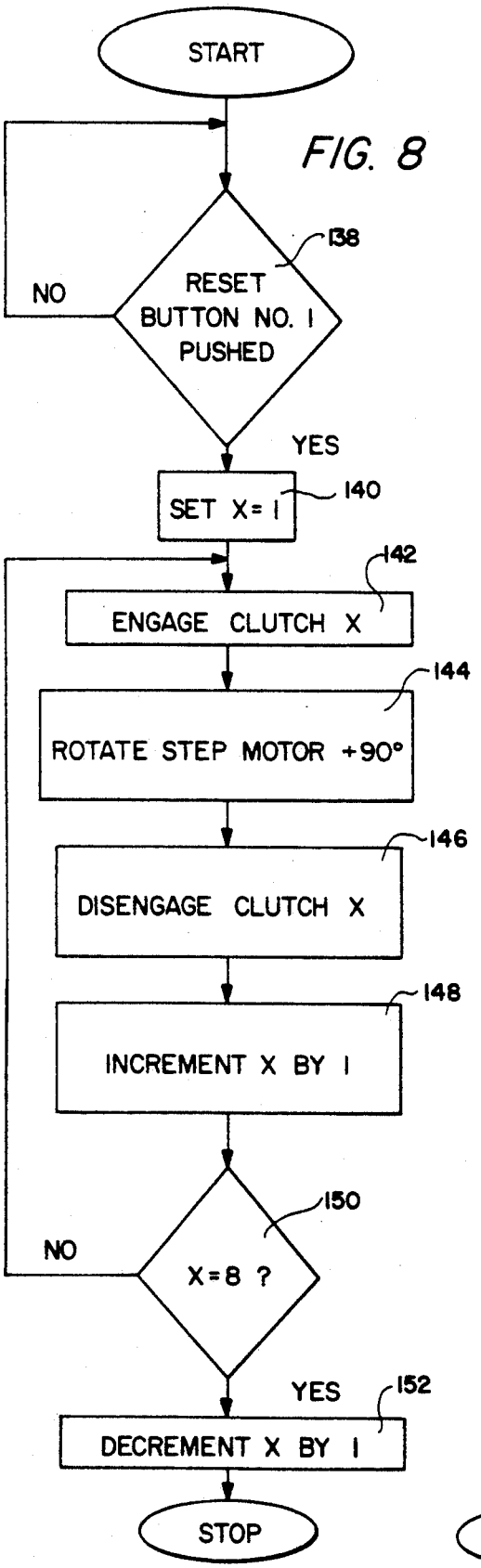
FIG. 8 is a flow chart showing the manner of resetting the drive arrangement prior to resupplying the dispensing apparatus.
Figure 9:
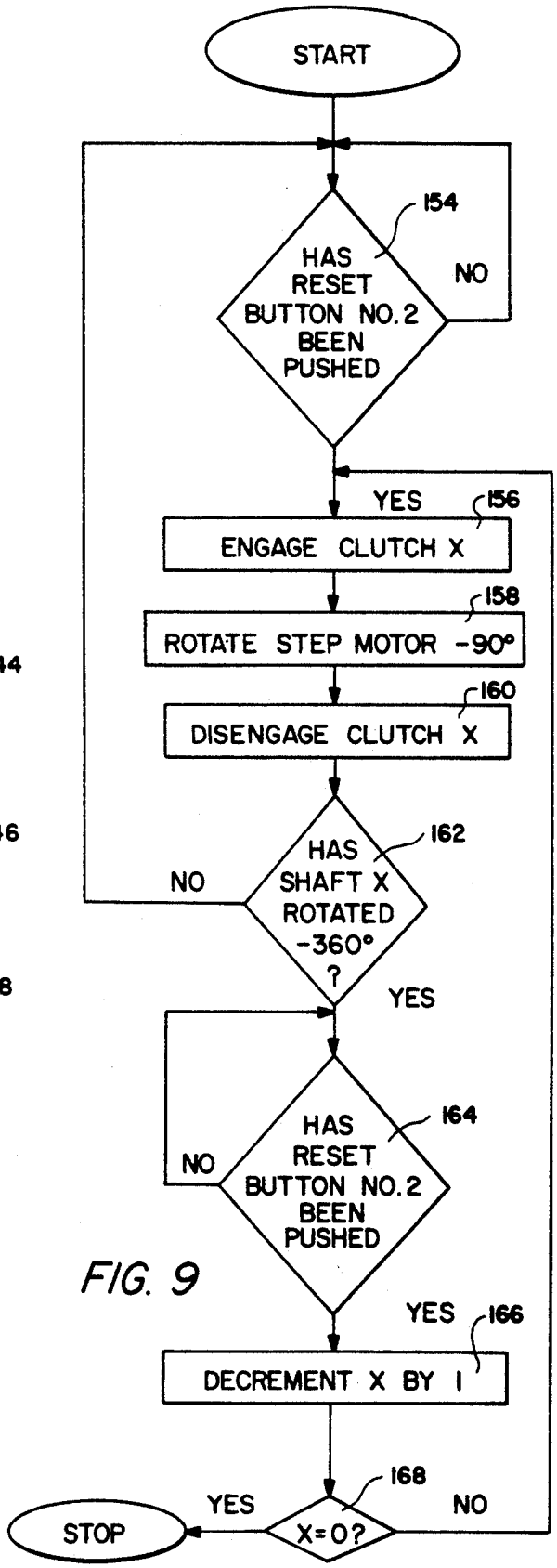
FIG. 9 is a flow chart showing the manner of resetting each compartment to enable the resupply of the dispensing apparatus.

FIGS. 8 and 9 are flow charts showing the steps involved in resetting base plates 20 in order to resupply dispensing apparatus 10. In FIG. 8, when the first reset button 46 is depressed, step 138, a counter (not shown) in microprocessor 76 is set to 1, step 140, the first electromagnetic clutch 90a is engaged with gear 80a, step 142, step motor 72 is operated to rotate shaft 70a 90 degrees in the forward direction, step 144, electromagnetic clutch 90a is disengaged from gear 80a, step 146, the counter is incremented by one, step 148, and until x=8, step 150, the loop is repeated, sequentially engaging electromagnetic clutches 90b through 90g with gears 80b through 80g so as to rotate shafts 70b through 70g 90 degrees in the forward or clockwise direction. Once x equals 8, step 150, x is decremented by 1, step 152, and the operation is stopped, with shaft 70g conditioned to be operated first upon the depression of the second reset button 48, the steps responsive to depression of reset button 48 being shown in FIG. 9.

With x set at 7 by step 152 in FIG. 8, when the second reset button 48 is depressed, step 154, FIG. 9, electromagnetic clutch 90g is engaged with gear 88g, step 156, step motor 72 is actuated to rotate gear 88g and shaft 70g 90 degrees in the counterclockwise or reverse direction, step 158, whereby the bottom base plate 20 belonging in the Sunday column is shifted to the right to enable the patient or the caretaker to deposit whatever medication that may have been prescribed for Sunday morning. Continuing with the flow chart, electromagnetic clutch 90g is disengaged from gear 88g, step 160. In this case shaft 70g has not rotated a negative 360 degrees as yet, step 162, so the program returns to the start position to await depression of reset button 48 a second time, step 154, to initiate a second cycle of operation, this time shifting the next highest base plate 20 in the Sunday column to the right to enable placement of medication thereon. This same cycle is repeated twice more, enabling the shifting of the remaining base plates 20 to the right in the Sunday column, and resupply of medication thereon. When shaft 70g has rotated 360 degrees in the negative or reverse direction the program then waits for reset button 48 to again be pushed, step 164. Once reset button 48 is depressed, x is decremented by 1, step 166. If x does not equal 1 the program goes to step 156 to repeat the cycles, this time with shaft x. These steps are repeated until all twenty-eight base plates 20 have been shifted to the right and loaded with the proper medication. When x=0, step 168, the step motor 72 shuts off, and apparatus 10 is ready to have cover 30 closed and locked in preparation for once again dispensing pills. Resilient bar 136 enables projections 62 to be positioned properly for engagement with paddles 68a–68d when shafts 70a–70g are rotated in the forward or clockwise direction.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A medicine reminder and dispenser for alerting a user at predetermined times that medication is to be taken, and for dispensing said medication at said predetermined times, comprising:

a plurality of container means for holding medication to be dispensed, each of said container means including a slidable base plate and a fixed wall means for brushing said medication off said slidable base plate when said base plate is moved;

housing means for housing said plurality of container means;

reversible drive means mounted in said housing means for sequentially shifting said slidable base plate means between an open and closed position;

microprocessor means for controlling the operation of said reversible drive means;

clock means mounted in said housing means and connected to said microprocessor means to indicate real time to said microprocessor and to a user;

input means for inputting to the microprocessor means said predetermined times for alerting the user and for dispensing said medication;

memory means connected to said microprocessor means for storing said predetermined times, said microprocessor means continuously comparing said predetermined times with said real time;

alarm means to alert the user, connected to said microprocessor means and actuated by said microprocessor means when there is a match between said predetermined times and said real time;

enabling means for enabling said drive means, connected to said microprocessor means and actuated along with said alarm means when there is said match between said predetermined times and said real time; and reset means for resetting said slidable base plates, connected to said microprocessor means and operable by the user during the resupply of said medicine reminder and dispenser; whereby a predetermined amount of medication may be retrieved by said user at each predetermined time.

2. A medicine reminder and dispenser as in claim 1, said housing means comprising:

a base shelf;

a left side wall integral with and perpendicular to said base shelf;

a right side wall integral with and perpendicular to said base shelf;

a back wall integral with and perpendicular to said base shelf, said left side wall, and said right side wall;

a front transparent sheet integral with and perpendicular to said left side wall and said right sidewall, a bottom edge of said transparent sheet being spaced from said base shelf;

a drawer slidably mounted on said base shelf below said bottom edge of said transparent sheet; and a top cover pivotally mounted on said back wall and engageable with a top edge of said transparent sheet when said cover is closed;

said top cover including a lock means to lock said cover in a closed position, whereby ready access to said containers is prevented, said housing forming a readably transported cabinet for said container means.

3. A medicine reminder and dispenser as in claim 2, wherein:

said containers are arranged in four rows, each containing seven columns, whereby medication may be dispensed four times a day for seven days;

said base plates having front and rear tongues slidable in grooves provided in front and rear beams;

said front and rear beams being supported on said left and right side walls;

said rear beams including an open slot for slidably receiving an extension of a portion of said rear tongues, said extension being engageable with said reversible drive means, whereby said base plates may be driven to the left for providing an opening enabling said medication to drop into said drawer, and to the right in a reset operation;

said fixed wall means being attached to at least one of said front and rear beams.

4. A medicine reminder and dispenser as in claim 3, said reversible drive means comprising:

a reversible step motor actuated by said enabling means, said step motor being mounted in said housing means;

a first gear driven by said step motor to rotate 90 degrees when said step motor is actuated;

a second gear mounted to be driven by said first gear;

a third gear coaxial with and connected to said second gear;

seven vertical shafts mounted for rotation on said base shelf, each shaft being located adjacent to a corresponding column to the rear of said rear beams;

each of said shafts having a gear rotatable independently at the top thereof and an axially slidable electromagnetic clutch engageable with said rotatable gear and connected to said shaft so as to rotate said shaft when engaged with said rotatable gear;

said rotatable gears being connected to said third gear by a timing belt means driven by said third gear;

said electromagnetic clutches being selectively actuated by said enabling means to engage a corresponding rotatable gear means, whereby the corresponding shaft is also rotated;

each of said shafts having four paddles thereon vertically spaced to correspond to said four rows of containers, and circumferentially spaced 90 degrees apart so as to enable said paddles to engage said extensions sequentially from the bottom row to the top row of each column.

5. A medicine reminder and dispenser as in claim 4, said enabling means comprising:

a step motor controller connected between said microprocessor means and said reversible step motor;

a delay means connected to said step motor controller, and actuated by an enable signal from said microprocessor means; and a multiplexer means connected between said microprocessor means and said electromagnetic clutches, and actuated by said enable signal; whereby a selected electromagnetic clutch is first engaged with the corresponding rotatable gear mounted on a corresponding shaft, and thereafter said step motor is actuated to drive said corresponding shaft 90 degrees.

6. A medicine reminder and dispenser as in claim 5, said input means comprising:

a plurality of push button switches vertically disposed on said left side wall of said housing to input desired times in hourly units;

a plurality of push button switches disposed along said top cover to input desired times in daily units; and a time input means interposed between said push buttons and said microprocessor means.

7. A medicine reminder and dispenser as in claim 1, said reset means comprising:

a first reset button mounted on said left side wall for providing a first reset signal;

a second reset button mounted on said left side wall for providing a second reset signal;

a reset input means connected between said reset buttons and said microprocessor means;

said first reset button actuating said drive means to drive said seven vertical shafts 90 degrees in the forward direction to locate a lowest paddle of said four paddles on each shaft in a position to engage said extensions on said base plates during reverse rotation of said shafts;

four manually actuatable push bars supported by said left side wall, and respectively located to engage each row of base plates to push said base plates sufficiently far to enable said paddles to properly engage said extensions with said paddles during reverse rotation of said shafts;

said second reset button being effective to selectively rotate said seven vertical shafts 90 degrees at a time in the reverse direction starting with the lowest base plate in the right-most column;

whereby said base plates may be returned to their respective original positions during resupply of said medicine reminder and dispenser;

said base plates in the right-most column having resilient bars on the right side thereon engageable with the right side wall to push the base plates in each row slightly to the left so as to push said extensions sufficiently to the left to enable said paddles to engage said extensions during a dispensing operation.

* * * * *